US008371161B2

(12) United States Patent
Simpson et al.

(10) Patent No.: US 8,371,161 B2
(45) Date of Patent: Feb. 12, 2013

(54) APPARATUS AND METHOD FOR FORMATION TESTING

(75) Inventors: Angus J. Simpson, Cypress, TX (US); Francisco Galvan-Sanchez, Houston, TX (US); Wade H. Bullock, Montgomery, TX (US); Marvin L. Raney, Pearland, TX (US); Marcelo F. Civarolo, The Woodlands, TX (US); Michael Shammai, Houston, TX (US); Jianghui Wu, The Woodlands, TX (US); Sefer B. Coskun, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 383 days.

(21) Appl. No.: 12/717,258

(22) Filed: Mar. 4, 2010

(65) Prior Publication Data

US 2010/0223990 A1 Sep. 9, 2010

Related U.S. Application Data

(60) Provisional application No. 61/158,085, filed on Mar. 6, 2009.

(51) Int. Cl.
*E21B 49/08* (2006.01)

(52) U.S. Cl. ..... 73/152.23; 166/264

(58) Field of Classification Search ..... 73/152.05, 73/152.23; 166/264
See application file for complete search history.

(56) References Cited

U.S. PATENT DOCUMENTS

| | | | | |
|---|---|---|---|---|
| 5,058,674 | A | 10/1991 | Schultz et al. | |
| 5,180,015 | A * | 1/1993 | Ringgenberg et al. | 166/386 |
| 5,609,205 | A | 3/1997 | Massie et al. | |
| 5,662,166 | A * | 9/1997 | Shammai | 166/264 |
| 6,216,782 | B1 * | 4/2001 | Skinner | 166/250.01 |
| 6,439,307 | B1 | 8/2002 | Reinhardt | |
| 6,557,632 | B2 | 5/2003 | Cernosek | |
| 6,568,487 | B2 | 5/2003 | Meister et al. | |
| 6,609,568 | B2 | 8/2003 | Krueger et al. | |
| 6,672,386 | B2 | 1/2004 | Krueger et al. | |
| 6,923,052 | B2 | 8/2005 | Krueger et al. | |
| 7,011,155 | B2 | 3/2006 | Meister et al. | |
| 7,027,928 | B2 | 4/2006 | DiFoggio | |
| 7,222,524 | B2 | 5/2007 | Shammai | |
| 7,234,521 | B2 | 6/2007 | Shammai et al. | |
| 7,258,167 | B2 * | 8/2007 | Shammai et al. | 166/264 |
| 7,266,983 | B2 | 9/2007 | Krueger et al. | |
| 7,395,703 | B2 | 7/2008 | Niemeyer et al. | |
| 7,665,354 | B2 | 2/2010 | Shammai | |
| 7,926,575 | B2 * | 4/2011 | Ringgenberg et al. | 166/375 |
| 2004/0055400 | A1 | 3/2004 | Ringgenberg et al. | |
| 2004/0129070 | A1 | 7/2004 | Bolze et al. | |

* cited by examiner

*Primary Examiner* — John Fitzgerald
(74) *Attorney, Agent, or Firm* — Cantor Colburn LLP

(57) ABSTRACT

An apparatus made according to one embodiment may include a first chamber configured to receive fluid under pressure and to compress a gas in a second chamber in pressure communication with the first chamber, wherein the second chamber is configured to discharge the fluid out from the first chamber when pressure of the fluid in the first chamber is reduced.

20 Claims, 2 Drawing Sheets

APPARATUS AND METHOD FOR FORMATION TESTING

CROSS REFERENCE TO RELATED APPLICATIONS

This application takes priority from U.S. Provisional Application Ser. No. 61/158,085 filed on Mar. 6, 2009.

BACKGROUND OF THE DISCLOSURE

1. Field of the Disclosure

The disclosure herein relates generally to apparatus and methods for formation testing.

2. Description of the Related Art

Oil wells (also referred to as "wellbores" or "boreholes") are drilled at selected locations in subsurface formations to produce hydrocarbons (oil and gas). Well tests in which pressure of the well is recorded over a time period are performed to estimate well or reservoir properties, determine the productivity of the well or obtain reservoir management data. A well test referred to in the industry as "drill-stem" test is an example of such a well test. In a typical drill-stem test, a driller isolates a region or section of the wellbore. The flow volume of the formation fluid is measured. A valve and a pressure transducer are lowered down a drill pipe in the wellbore. A packer is expanded to isolate a region of the wellbore. The valve is then opened, which causes the pressure at the wall of the wellbore to fall sharply and allows the formation fluid to flow into the wellbore. Such a state is generally referred to as the "flow" state. During the flow-state, the pressure decreases over time. The variations in the pressure are recorded. Also, the volume of fluid flowing in the well is recorded. The valve is then shut for a time period (referred to as the "shut-in" period), causing the pressure to build up on the wall of the wellbore. The rate of recovery of the pressure is recorded during the shut-in period. The rate of recovery of the pressure, combined with the known amount of fluid produced during the test enables an operator to estimate properties of the formation, such as permeability and far field pressure.

Such a drill-stem tests is performed over a long time period. In some situations, however, it is desirable to perform short drill-stem tests at different wellbore depths to estimate the various formation properties. A dual packer module on a wireline is often used to perform the functions performed during a drill-stem test, but on a smaller scale. Such tests are referred to as mini drill-stem tests. A mini drill stem-test investigates a smaller volume of formation fluid due to smaller isolated region (for example three feet versus tens of feet) and withdraws a smaller amount of fluid at a lower flow rate. When performing a mini drill-stem test, it is desirable to generate a sufficiently large pressure drop in order to maximize the depth of investigation of the permeability measurement as well as to increase the signal to noise ratio of the pressure build up. Therefore, a large volume drawdown chamber is used in combination with a flow control mechanism to generate a sufficiently large pressure drop while maintaining a near constant fluid flow rate. A variable pressure control draw down chamber is often used to allow for a controlled pressure drop while measuring the fluid flow rate into the draw down chamber in real time. Such tests, however, do not allow for performing drill-stem tests at various depths during a single trip into a well. Therefore, it is desirable to provide an apparatus for performing mini drill-stem tests at multiple depths during a single trip in the wellbore.

SUMMARY OF THE DISCLOSURE

The disclosure, in one aspect, provides an apparatus that in one embodiment may include; a first chamber configured to receive a fluid under pressure and to compress a gas in a second chamber in pressure communication with the first chamber, wherein the compressed gas expands when the pressure of the fluid in the first chamber is reduced to cause the fluid in the first chamber to discharge out of the first chamber. In another aspect, the apparatus may further include a fluid flow control device between the first and second chambers.

A method for performing a test in a wellbore is provided, which method, in one aspect, may include: supplying a fluid from a selected zone in the wellbore into a first chamber that is in pressure communication with a second chamber that contains a gas therein at a first pressure, thereby causing the gas in a second chamber to compress to a second pressure that is greater than the first pressure; taking a measurement relating to parameter of interest during supplying of the fluid into the first chamber; and reducing pressure in the first chamber to cause the compressed gas at the second pressure to expand to move the fluid out from the first chamber, thereby resetting the first chamber to again receive the fluid therein.

Examples of certain features of apparatus and method to perform formation testing are summarized rather broadly in order that the detailed description thereof that follows may be better understood. There are, of course, additional features of the apparatus and method disclosed hereinafter that will form the subject of this disclosure.

BRIEF DESCRIPTION OF THE DRAWINGS

For a detailed understanding of the present disclosure, references should be made to the following detailed description of the embodiments, taken in conjunction with the accompanying drawings, in which like elements have generally been given like numerals, wherein.

DETAILED DESCRIPTION OF THE EMBODIMENTS

Figure 1:
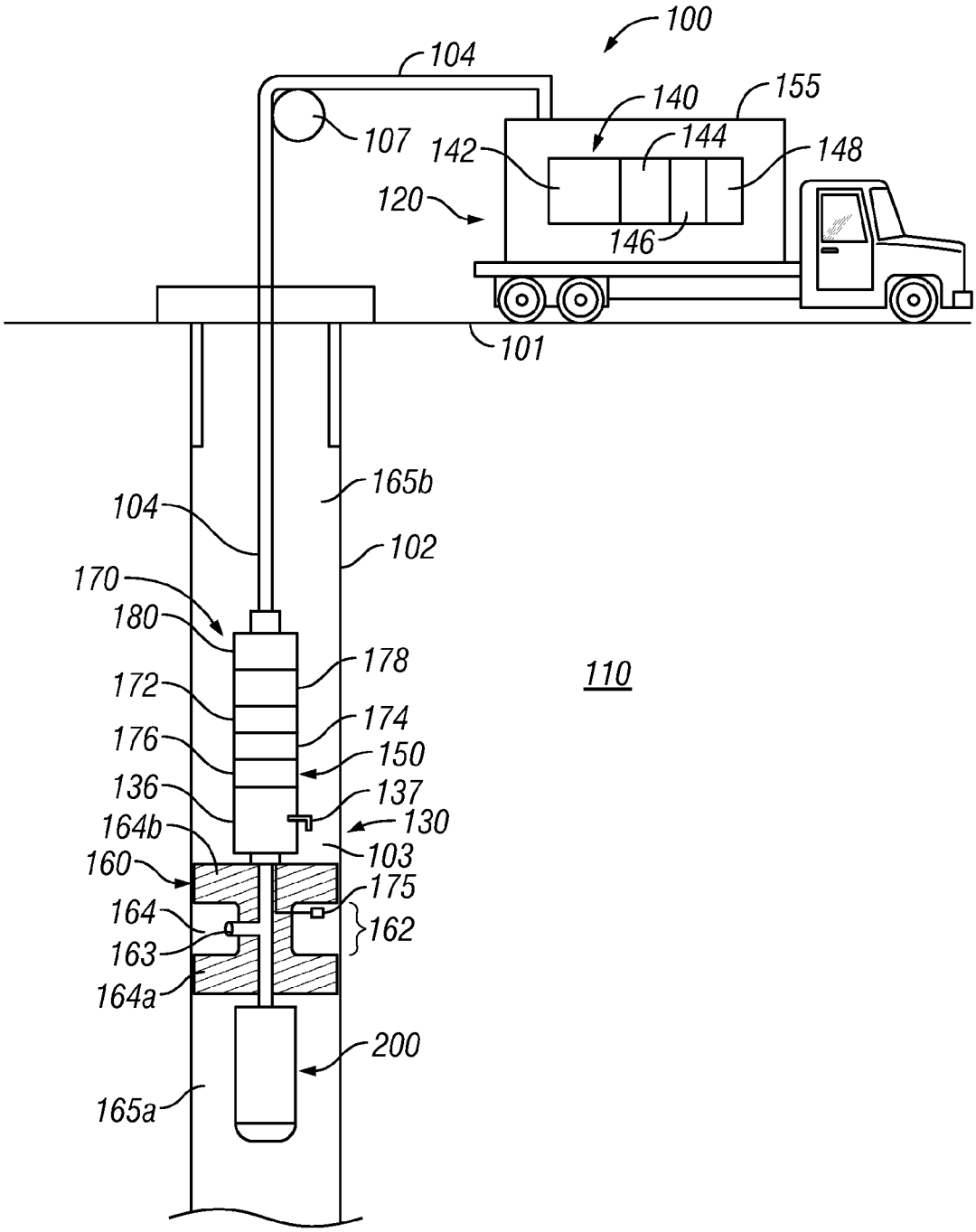
FIG. 1 is a schematic illustration of an apparatus, made according to one embodiment of the disclosure, conveyed in a wellbore penetrating a formation for performing a formation test.

FIG. 1 a schematic diagram of an exemplary formation testing system 100 that shows a downhole apparatus 130 (also referred to herein as a "tool"), made according to one embodiment of the disclosure, conveyed into a wellbore 102 formed in a formation 110 via a conveying member 104 (such as a wireline, slickline, etc.) from a surface location 101. The apparatus 130 is shown to include a power and electronic section 150, a formation testing tool 200 and an isolation device 160. The isolation device 160 in an inactive state remains contracted and may be expanded to isolate a selected zone of the wellbore 102. In FIG. 1, the isolation device 160 is shown in an expanded position isolating the zone 162 of the wellbore 102. The isolated wellbore zone 162 contains the wellbore fluid 164 and is in pressure communication with the formation 110. The isolation device 160 may be any suitable device for isolating a wellbore zone, including, but not limited to, a straddle packer as shown in FIG. 1. Straddle packers and other isolation devices are known in the art and therefore their structures are not described in detail herein. The formation testing tool 200, in one aspect, may be a drill-stem testing tool. A drill-stem testing tool made according to one embodiment of the disclosure is described in more detail in reference to FIGS. 2 and 3. In another aspect, the power and control section 150 may include a device 136, such as a pump, configured to pump fluid 164 from the isolated section 162 into the formation testing tool 200. The device 136 may also be configured to pump the fluid out from the formation testing tool 200 and discharge it into the wellbore at a selected location, such as a location 103 above or uphole of the isolation device 160 via a fluid line 137. The power and control section 150 may further include a controller or control unit 170, which may further include a processor 172, such a microprocessor, a storage device 174 accessible to the processor 172, such a memory device, which may be any suitable device, including, but not limited to, a random access memory, flash memory, and read-only-memory. One or more computer programs and data 176 may be stored in the storage device 174 for use by the processor 172 to execute instructions contained in the programs 176. The conveying member 104 is coupled at the surface to a control unit or controller 140, which may be computer-based unit that includes a processor 142, a storage device 144 and programs and data 146 stored in the storage device 144 and accessible to the processor 142.

Still referring to FIG. 1, to perform a test using system 100, the apparatus 130 is conveyed from a platform 120 at the surface 101 via the conveying member 104. The conveying member 104 may be any suitable member, including, but not limited to, a wireline, slickline and coiled tubing that supplies power to the tool 130 and established bi-directional data communication between the tool 130 and the surface controller 140. The tool 130 is then set at a selected location or depth and the isolation device 160 activated to isolate the region 162. The isolation members 164*a* and 164*b* are expanded to seal the inside of the wellbore 102 such that there is no fluid flow between the zone 165*b* above or uphole of the isolation device 160 and the zone 165*a* below or downhole of the isolation device 160. The power section 150 is then activated to controllably discharge the fluid 164 from the isolated zone 162 into the testing tool 200 via line 163. In one aspect, the controller 170 may control the operation of the power device to control the flow of the fluid 164 based on the instructions contained in the programs 176 and/or instructions provided by the controller 140 or instructions sent by an operator at the surface or a remote control unit (not shown). One or more sensors 175 may be utilized to provide signals corresponding to the pressure of the fluid 164 or formation to the processor. Electronic circuits 178 may be provided to process sensor 175 signals. A telemetry unit 180 may be provided in the apparatus 130 to establish bi-directional signal and data communication between the tool 130 and the surface controller 140.

Figure 2:
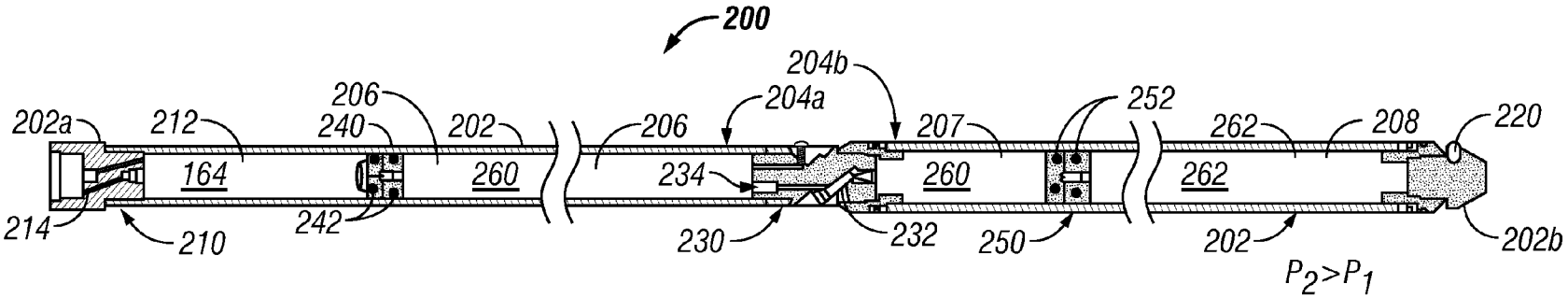
FIG. 2 is cross section of a portion of the apparatus in FIG. 1, made according to one embodiment of the disclosure.

FIG. 2 shows a cross-section of a formation testing tool 200 according to one embodiment of the disclosure. The tool 200 is shown to include a housing 202 having a top end 202*a* and a bottom end 202*b*. A fluid intake device 210 is shown coupled to the top end 202*a* of the housing 200 and a gas charging device 220 is shown coupled to the bottom end 202*b* of the housing 202. A fluid flow control device 230 is shown disposed in the housing 202. A movable sealing device 240 is disposed between the upper end 202*a* and the fluid flow control device 230 and another movable sealing device 250 is disposed between the lower end 202*b* and the fluid flow control device 230. The fluid flow control device 230 may be affixed inside the housing 200 at a selected location or may be affixed between sections 204*a* and 204*b* comprising the housing 202. The fluid flow control device 230, in one configuration, may include a suitable flow gauging device 232, which may be set or configured for a desired flow rate. The fluid flow gauging device 232 may be any suitable device, including, but not limited to a mechanical valve, such as a check valve, and an electrically-operated valve. The movable sealing devices 240 may be a floating piston with seal members 242 providing a fluid seal between the housing 202 and the movable sealing member 240. The seal members 242 may be o-rings. Similarly, the movable sealing device 250 may also be a floating piston having seal members 252.

Still referring to FIG. 2, the fluid flow control device 230 is at a fixed position and the space or chamber 206 between the movable seal member 240 and the fluid flow control device 230 is filled with a non-compressible fluid 260, such as oil, so that the movable sealing device 240 is close to or abuts against the fluid intake device 210. The space or chamber 208 between the gas charging device 220 and the movable seal member 250 is charged or filled with a gas 262, such as nitrogen or air, under pressure, which pressure, for example, may vary from a few hundred psi to a few thousand psi. When the chamber 208 is charged with a gas, the movable member 250 is close to or abuts against the fluid flow control device 230. The chambers 206 and 208 are charged at the surface and the tool 200 is attached to the tool 130, either below or above the isolation device 160.

Referring to FIGS. 1 and 2, to perform a formation test, the apparatus 130 is conveyed into the wellbore to a selected depth. The isolation device 160 is set to isolate a wellbore zone, such as zone 162. The power unit 136 is operated to pump the fluid 164 from the isolated zone 162 into the tool 200. The fluid 164 enters the space or chamber 212 via an opening or intake line 214 in the intake device 210 and forces the movable sealing device 240 to move toward the fluid flow control device 230. The fluid 260 from the chamber 206 passes into the chamber 207 via the fluid line 234 in the flow control device 230 and causes the movable sealing device 250 to move toward the gas charging device 220, compressing the gas 262 in the chamber 208. This process may continue until the gas 262 can not be compressed further. The compressed gas 262 in chamber 208 at this stage is at pressure that is substantially higher than the pressure of the gas prior to pumping the fluid 164 into the chamber 212. For the purpose of explanation, the initial pressure in the chamber 208 is denoted as P1 and the pressure after the movable member has moved toward the gas charging section 220 is denoted as P2, wherein P2 is generally substantially greater than P1. The flow rate of the fluid 164 received in chamber 212 may thus be controlled by the flow rate set by the fluid control device 230. This mechanism, thus, enables a controlled drawdown of the fluid 164 from the isolated formation section 162. One or more sensors, such as sensors 175 (FIG. 1), provide continuous pressure measurement prior to, during and after the drawdown process. Temperature sensors and other suitable sensors may be utilized to provide continuous downhole temperature measurements and measurements of other desired parameters of interest, including the drawdown rate. The drawdown rate, pressure and temperature measurements may be utilized by the controller 170 and/or controller 140 to perform the formation testing analysis.

Still referring to FIGS. 1 and 2, once the test has been performed at a first location, the tool 200 may be reset and moved to a second location in the wellbore to perform the test at such second location, without removing the apparatus 130 from the wellbore 102. In such a case, the pump 136 may be operated in a reverse direction to withdraw the fluid 164 from the chamber 212 and discharge the withdrawn fluid into the wellbore 102 via the discharge line 137 associated with the pump 136. As the fluid 164 from the chamber 212 leaves the tool 200 via the fluid line 214, the compressed gas 262 in chamber 210 forces the movable seal member 250 to move toward the fluid flow control device 230, causing the fluid 260 in the chamber 207 to move back to chamber 206. Continued removal of the fluid 164 from the chamber 212 resets the tool 200 to its initial setting and makes it ready for reuse without the need for removing the tool from the wellbore. When the pressure P2 is greater than the pressure in zone 165*b*, such a pressure will also cause the fluid 164 to discharge from the chamber 212.

Figure 3:
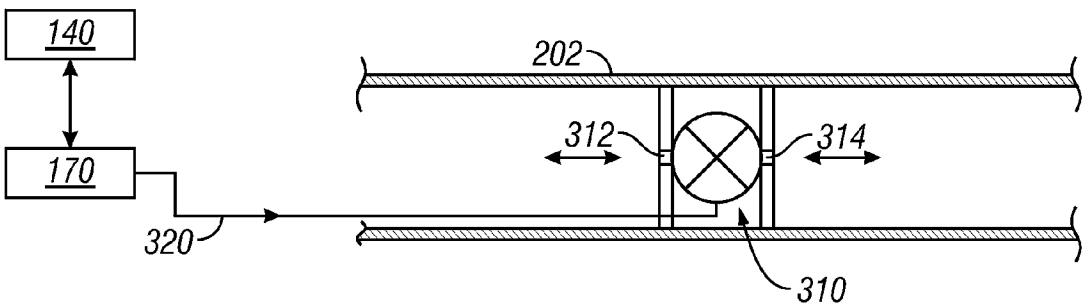
FIG. 3 is a schematic diagram showing an exemplary electrically-operated fluid flow control device that may be utilized in the apparatus shown in FIG. 2.

FIG. 3 shows a circuit containing an electrically-operated fluid flow control device 310, such as an electrically-operated valve, for controlling the drawdown rate of the fluid 164 from the isolated zone 162. Referring to FIGS. 1-3, the fluid flow control device 310 may be coupled to the controller 170 or circuitry 178 via a line 320 run inside or along the housing 202. Openings 312 and 314 in the fluid flow control device 310 provide fluid communication between the chambers 206 and 207. In operation, the controller 170 and/or 140 may set the device 310 at a desired flow rate before and/or during the drawdown process. Such a device allows for in-situ changing of the drawdown rate compared to mechanical devices that are set at the surface.

Thus, the disclosure, in one aspect, provides an apparatus that includes a first chamber containing a first fluid that is in hydraulic communication with a second chamber; a third chamber containing gas under pressure in pressure communication with the second chamber; and a movable device configured to apply pressure on the fluid in the first chamber to move the fluid from the first chamber to the second chamber.

Another embodiment of the apparatus may include; a first chamber configured to receive a fluid under pressure and to compress a gas in a second chamber in pressure communication with the first chamber, wherein the compressed gas expands when the pressure of the fluid in the first chamber is reduced to cause the fluid in the first chamber to discharge out of the first chamber. In another aspect, the apparatus may further include a fluid flow control device between the first and second chambers. In another aspect, the apparatus may further include a first movable seal member between the first chamber and the fluid flow control device and a second movable seal member between the fluid flow control device and the second chamber.

In one aspect, the space between the first movable seal device and the fluid flow control device may be filled with a hydraulic fluid, wherein the fluid flow control device enables the hydraulic fluid to move into a space between the fluid flow control device and the second movable seal device. In another aspect, the fluid flow control device may be placed in a housing to form the first and second chambers on opposing sides of the fluid flow control device. The first movable seal device and the second movable seal device may comprise a piston configured to move in the housing. The fluid flow control device may be any suitable device, including, but, not limited to, a mechanical valve and an electrically-operated valve.

A power unit may be used to pump the fluid under pressure into the first chamber. In one aspect, a controller may be provided downhole and/or at the surface to control the operation of the power unit and fluid flow control device. The apparatus may further include a seal device configured to isolate a zone of the wellbore. In one aspect, the seal device may include a pair of spaced apart seal elements configured to expand in the wellbore to provide an isolated wellbore zone therebetween. In one aspect, one or more sensors may be provided to take measurements relating to one or more parameters of interest, which parameters may include pressure, temperature and fluid flow rate. In another aspect, the controller in the tool and/or or at the surface may provide an estimate of a formation parameter using the measurements provided by the one or more sensors. The formation parameter may include permeability and anisotropy.

In another aspect, the apparatus according to another embodiment may include a downhole tool that may further include: a fluid flow control device in a housing having a first end and a second end; a first movable seal member between the first end of the housing and the fluid flow control device forming a first chamber between the first end of the housing and the first movable seal member and a second chamber between the first movable seal member and the fluid flow control device; a second movable seal member between the second end of the housing and the fluid flow control device forming a third chamber between the second end of the housing and the second movable seal member and a fourth chamber between the first movable seal member and the fluid flow control device; a hydraulic fluid in the second chamber and a gas in the fourth chamber; and wherein when a fluid is supplied under pressure to the first chamber, the first movable member moves to cause the hydraulic fluid to move from the second chamber to the third chamber, thereby compressing the gas in the fourth chamber; and when pressure in the first chamber is reduced, the gas expands to cause the hydraulic fluid to move from the third chamber to the second chamber. In another aspect, such apparatus may further include: a sealing element configured to isolate a portion of the wellbore; and a power unit configured to supply the fluid under pressure to the first chamber. The apparatus may further include a fluid intake device at the first end of the housing configured to enable the fluid under pressure to enter into the first chamber and a gas intake device at the second end of the housing configured to allow introducing the gas into the fourth chamber. A conveying member may be attached to the tool for conveying the apparatus in the wellbore. One or more controllers may be provided to process information received from one or more sensors in the apparatus to provide an estimate of a parameter of interest.

In another aspect, a method of performing a test in a wellbore is provided, which method in one embodiment, may include: supplying a fluid from a selected zone in the wellbore into a first chamber that is in pressure communication with the second chamber that contains a gas therein at a first pressure, causing the gas in a second chamber to compress to a second pressure that is greater than the first pressure; taking a measurement relating to parameter of interest during supplying of the fluid into the first chamber; and reducing pressure in the first chamber to cause the compressed gas at the second pressure to expand and move the fluid out from the first chamber, thereby resetting the first chamber to again receive a fluid therein. The method may further include controlling flow rate of the fluid into the first chamber. The taking of a measurement relating to a downhole parameter may be performed by one or more downhole sensors. The method may further include estimating a formation parameter using the measurement of the downhole parameter.

The foregoing disclosure is directed to certain embodiments that may include certain specific elements. Such embodiments and elements are shown as examples and various modifications thereto apparent to those skilled in the art may be made without departing from the concepts described herein. It is intended that all such variations are within the scope of the foregoing disclosure.

What is claimed is:

1. An apparatus for use in a wellbore, comprising:

a first chamber containing a hydraulic fluid therein;

a second chamber configured to contain gas therein and in pressure communication with the first chamber;

a third chamber in pressure communication with the first chamber, the third chamber configured to receive a downhole fluid, wherein receiving the downhole fluid in the third chamber causes the hydraulic fluid to compress the gas in the second chamber; and a pump configured to supply the formation fluid to the third chamber.

2. The apparatus of claim 1, wherein expansion of the gas in the second chamber expels the downhole fluid from the third chamber.

3. The apparatus of claim 1 further comprising a movable seal between the first chamber and the second chamber.

4. The apparatus of claim 1 further comprising a movable seal between the first chamber and the third chamber.

5. The apparatus of claim 1 further comprising a power unit configured to supply the downhole fluid to the third chamber.

6. The apparatus of claim 1 further comprising a device configured to isolate a zone of a wellbore.

7. The apparatus of claim 1, wherein the first chamber includes a first section and a second section, the apparatus further comprising a flow control device configured to control movement of the hydraulic fluid between the first section and the second section.

8. The apparatus of claim 7, wherein the flow control device is a valve that selectively allows the hydraulic fluid to flow between the first section and the second section.

9. The apparatus of claim 1 further comprising a sensor configured to provide measurements relating to a parameter of interest.

10. The apparatus of claim 9, wherein the parameter of interest is one of: pressure; temperature; fluid flow rate; permeability; and anisotropy.

11. The apparatus of claim 9 further comprising a controller configured to provide an estimate of a formation parameter using the measurements provided by the sensor.

12. A method for use during a wellbore operation, comprising:

conveying an apparatus to a selected location in a wellbore, the apparatus including a first chamber having a hydraulic fluid therein and a second chamber containing a gas therein and a third chamber for receiving a downhole fluid, wherein the first, second and third chambers are in pressure communication with each other;

pumping a downhole fluid into the third chamber to cause the hydraulic fluid to move and in turn cause the gas to compress in the third chamber; and releasing the downhole fluid from the third chamber into the wellbore to enable the gas to expand in the second chamber.

13. The method of claim 12 further comprising:

moving the apparatus to another location in the wellbore; and pumping a downhole fluid associated with the another location into the third chamber to cause the hydraulic fluid to move and in turn cause the gas to compress in the third chamber to temporarily store the downhole fluid associated with the other location in the third chamber, thereby allowing the apparatus to store and release the downhole fluid from different locations in the wellbore without retrieving the apparatus from the wellbore.

14. The method of claim 12, wherein the downhole fluid is a formation fluid and wherein the method further comprises pumping the formation fluid into the third chamber.

15. The method of claim 14 further comprising using a sensor to obtain a measurement relating to a parameter of interest during supplying of the downhole fluid into the third chamber.

16. The method of claim 15, wherein the parameter of interest is one of pressure and flow rate.

17. The method of claim 16 further comprising estimating a property of interest of a formation using the sensor measurement.

18. An apparatus for use in a wellbore operation, comprising:

a fluid containment tool that includes a first chamber containing a hydraulic fluid therein, a second chamber containing gas and a third chamber for receiving a formation fluid, wherein the first, second and third chambers are in pressure communication with each other;

a pump configured to supply the formation fluid to the third chamber;

a sensor for providing a measurement relating to a parameter of interest during supply of the formation fluid to the third chamber; and a controller configured to estimate a property of the formation using the measurements provided by the sensor.

19. The apparatus of claim 18 further comprising an isolation device configured to isolate a section of the wellbore.

20. The apparatus of claim 18 further comprising a gas intake device associated with the second chamber to allow supply of the gas to the second chamber and fluid intake device associated with the third chamber to allow supply of the formation fluid to the third chamber.

* * * * *